United States Patent [19]

Richier

[11] 4,283,102

[45] Aug. 11, 1981

[54] ELECTRIC SOCKET-OUTLET

[76] Inventor: Paul Richier, Montée Saint-Lazare, Digne, France

[21] Appl. No.: 23,446

[22] Filed: Dec. 14, 1978

[30] Foreign Application Priority Data

Dec. 16, 1977 [FR] France ..... 77 39232
May 22, 1978 [FR] France ..... 78 16340

[51] Int. Cl.[3] ..... H01R 13/44
[52] U.S. Cl. ..... 339/42
[58] Field of Search ..... 339/42, 40

[56] References Cited

U.S. PATENT DOCUMENTS

| | | | |
|---|---|---|---|
| 896,838 | 8/1908 | Klein | 339/42 |
| 3,202,812 | 8/1965 | Berry et al. | 339/42 |
| 3,599,167 | 8/1977 | Adrian et al. | 339/42 |
| 3,915,536 | 10/1975 | Glantz | 339/111 |
| 4,148,536 | 4/1979 | Petropoulsos et al. | 339/42 |

FOREIGN PATENT DOCUMENTS

| | | | |
|---|---|---|---|
| 99574 | 4/1925 | Fed. Rep. of Germany | 339/45 M |
| 634693 | 9/1936 | Fed. Rep. of Germany | 339/111 |

*Primary Examiner*—Joseph H. McGlynn
*Attorney, Agent, or Firm*—Murray and Whisenhunt

[57] ABSTRACT

The electric socket-outlet of the present disclosure is constructed to minimize the danger of electrocution which arises more especially where children might introduce slender metallic objects into the socket apertures.

The socket-outlet is provided with an insulating casing, a front wall pierced with holes, conductive sockets aligned with said holes and intended to receive the conductive pins of a male plug, an insulating connection panel mounted with a capacity for displacement parallel with the axes of the said conductive sockets, means ensuring the return of the said connection panel to the vicinity of the said front wall and its retention there, a back wall, contacts mounted on said back wall and adapted for connection to an electric current source, means by virtue of which it is possible to displace the said connection panel in the direction of the said back wall when the pins of a male plug are engaged in the female socket-outlet, so as to effect the junction of the said connection members and the said contact, apertures in the connecting panel arranged opposite to the conductive sockets, and connection members offset in relation to the axes of the said conductive sockets to which these connection members are connected, wherein said contacts are located opposite to the connection members, likewise offset in relation to the axes of the conductive sockets, and are spaced from the said connection members when the connection panel is occupying a position close to the front wall of the socket-outlet.

10 Claims, 11 Drawing Figures

ELECTRIC SOCKET-OUTLET

BACKGROUND TO THE INVENTION

The present invention relates to an anti-electrocution electric socket-outlet.

The usual female current connectors, where the conductive sockets are constantly live, constitute a danger of electrocution, especially for children who might introduce slender metallic objects into these sockets.

Attempts have already been made to remedy this serious drawback by creating socket-outlets for example where the conductive sockets are rendered live only after a male plug has been inserted. For example an electric socket-outlet is known inside which an actuating element is lodged which is disposed on the path of the two pins of a male plug and carries springs which actuate rockers articulated on contacts integral with the conductive sockets of the said outlet, which contacts come into contact with the terminals of the socket-outlet.

However the safety conferred by this device is quite relative, since it is sufficient to introduce slender objects through the sockets of the outlet, in order to push back the actuating element and thus render the said sockets live.

A current socket-outlet is likewise known which comprises a casing for the guidance of a movable element subject to the action of as many independent locking bolts as there exist conductors to be connected to the fixed terminals of the said casing, the bolts being equipped with neutralization members placed on the push-in path of the pins of a male plug, the mobile element then having holes for the guidance, at least at the end of the push-in travel, of these pins which constitute a member secondarily co-operating with a cinematic transormation mechanism for the drive of the said mobile element in order to bring it, against the action of an elastic return member to which it is subjected, from a "neutral" position in which it is normally locked by the bolts into a "live" position in which the said pins are connected to the terminals by connection members.

The use of such a socket-outlet necessitates a double movement of insertion and rotation of the male plug, which is possible only at the cost of a constructional complication which causes break-downs and a prohibitive cost.

Furthermore the traditional socket-outlets, like the anti-electrocution socket-outlets already proposed, present a danger deriving from the fact that the lid or front wall is fixed by easily operable screws, and thus can be removed quite easily by children, which has the consequence of rendering the live terminals of the said outlets accessible to the children.

OBJECTS OF THE INVENTION

One objective of the object of the invention is the realization of an anti-electrocution socket-outlet which gives absolute security, is simple and reliable in operation, and has no appreciable constructional complication.

Another objective of the present invention is the obtaining of an anti-electrocution socket-outlet equipped with a closure system the manner of unlocking of which is virtually incomprehensible to children and necessitates the use of a special key.

SUMMARY OF THE INVENTION

According to the invention I provide an anti-electrocution electric socket-outlet, comprising an insulating casing, a front wall pierced with holes, conductive sockets aligned with said holes and intended to receive the conductive pins of a male plug, an insulating connection panel mounted with a capacity for displacement parallel with the axes of the said conductive sockets, means ensuring the return of the said connection panel to the vicinity of the said front wall and its retention there, a back wall, contacts mounted on said back wall and adapted for connection to an electric current source, means by virtue of which it is possible to displace the said connection panel in the direction of the said back wall when the pins of a male plug are engaged in the female socket-outlet, so as to effect the junction of the said connection members and the said contact, apertures in the connecting panel arranged opposite to the conductive sockets, and connection members offset in relation to the axes of the said conductive sockets to which these connection members are connected, wherein said contacts are located opposite to the connection members, likewise offset in relation to the axes of the conductive sockets, and are spaced from the said connection members when the connection panel is occupying a position close to the front wall of the socket-outlet.

According to a further characteristic the movable connection panel carries drive barrels oriented towards the front and disposed in alignment with the reception sockets for the pins of the male plug, these drive barrels being constituted by small tubes open at their extremities, the bore of which has a diameter less than the standardised diameter of the said pins and corresponds to the apertures of the connection panel, so that when a plug is engaged in the socket-outlet the pins of the said plug push pack the said drive barrels, the rearward displacement of which effects that of the said mobile connection panel into the electric contact position, while if a child introduces a conductive rod into the socket outlet it will pass freely through the drive barrels and the mobile connection panel, without being able to cause rearward movement of the latter into the electric contact position.

According to a further characteristic the socket-outlet is provided with locking means which prohibit the rearward movement of the connection panel other than by the introduction of a matching male plug into the said socket-outlet.

The second of the above-mentioned objectives is achieved by means of a socket-outlet the casing of which comprises at least one removable wall which can be constituted by the cover or back plate of the said casing and carries two flexible locking tongues which engage with their free extremities in two notches with which two opposite walls of the casing are provided internally, which walls comprise piercings entering the said notches and intended to permit the passage of the noses of an unlocking instrument.

DESCRIPTION OF PREFERRED EMBODIMENT

In order to render the following description clear and concise, corresponding parts of the various forms of embodiment illustrated and described are designated by the same references.

The electric socket-outlet comprises a casing 1 of parallelepipedic or other form, made of insulating material.

This casing can form an assembly with the actual socket-outlet before the latter is installed (as in the case of the examples represented in FIGS. 1 to 6 and 11), or can be previously permanently set into the outer or inner walls M of the premises, in the carrying out of the electrical installation.

Figure 3:
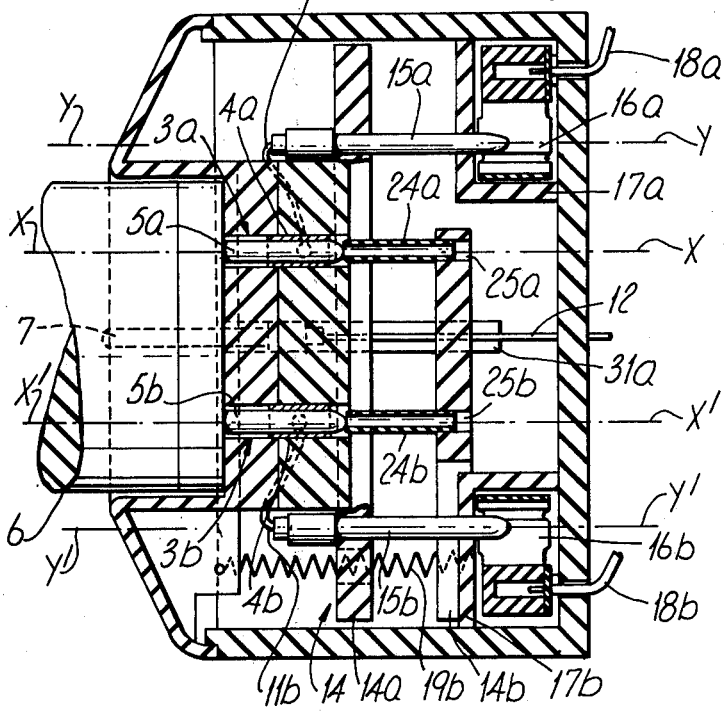
FIG. 3 is a broken sectional view passing through the axes of the connection pins and the drive barrels, showing the said socket-outlet in the conduction position resulting from the introduction of a male plug.
Figure 4:
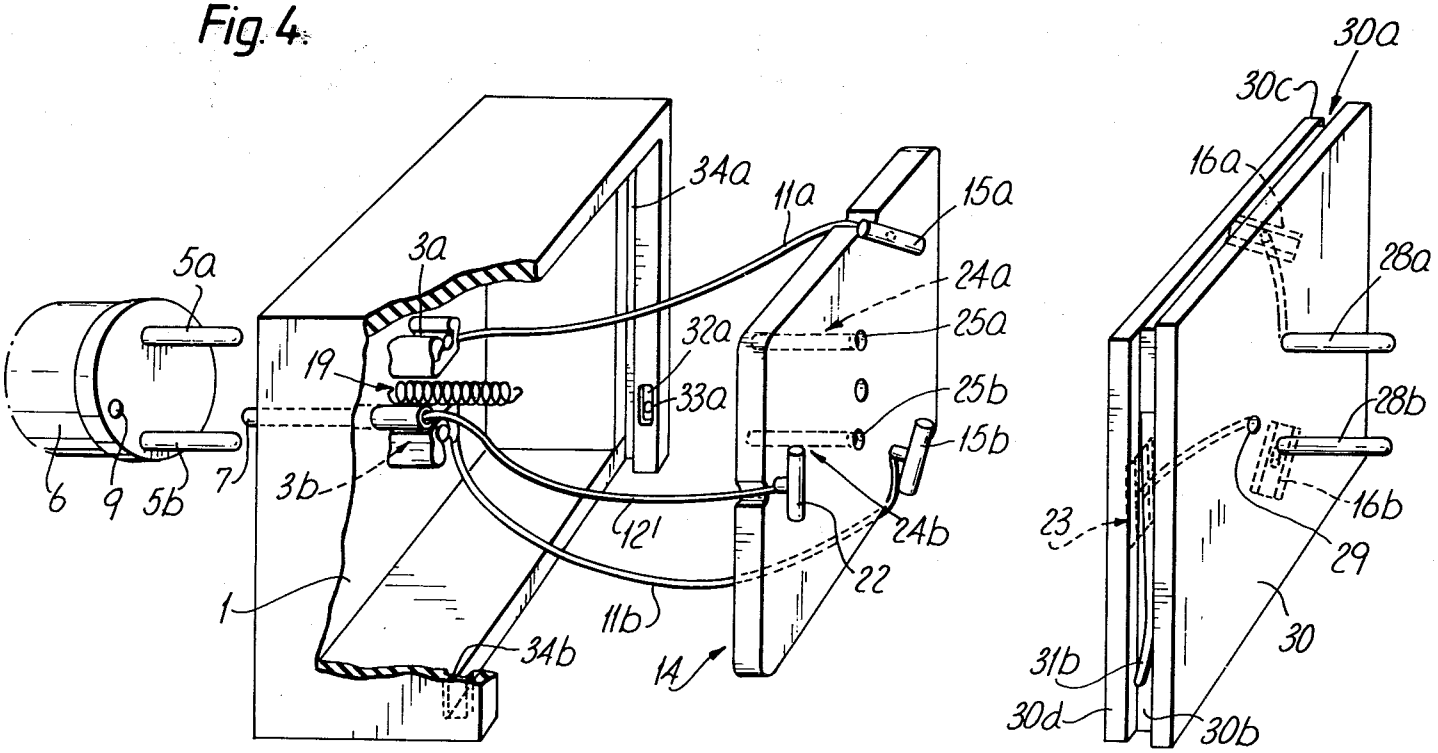
FIG. 4 is an exploded perspective view of another form of embodiment of the socket-outlet in accordance with the invention.
Figure 5:
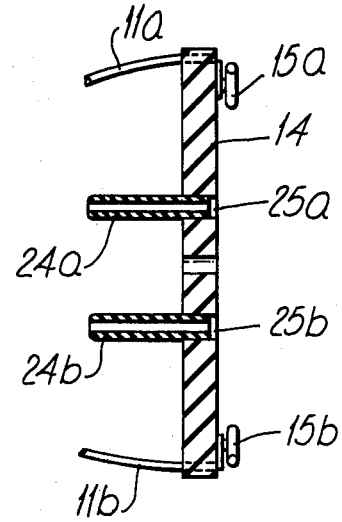
FIG. 5 is a sectional view of the connection panel of this socket-outlet, passing through the axes of the drive barrels of the said connection panel.

Moreover this casing comprises at least one removable wall which can be constituted by the front cover or wall 2 of the said casing (FIGS. 1 to 3 and 7 to 11), or by a back plate carrying the live contacts (FIGS. 4 and 5).

The front plate 2 comprises in the central part of its rear face, a thicker part 2*a* through which the holes 3*a*–3*b* are pierced in which there are fixedly installed the conductive sockets 4*a*–4*b* intended to receive the pins 5*a*–5*b* of a two-pin or other male plug 6. Moreover in the conventional manner a pin 7 is fixedly mounted in a third hole 8 likewise formed in the thicker part 2*a*, this pin emerging from the front face of the front plate and being intended for insertion in the earth socket 9 of the plug 6.

Each socket 4*a*–4*b* is connected, for example by means of a screw connector 10*a*–10*b* with which it is fast, to the end of a flexible conductor 11*a*–11*b* protected by an insulator.

Moreover the pin 7 is connected to the end of another flexible conductor 12 or 12' likewise protected by an insulator.

Figure 1:
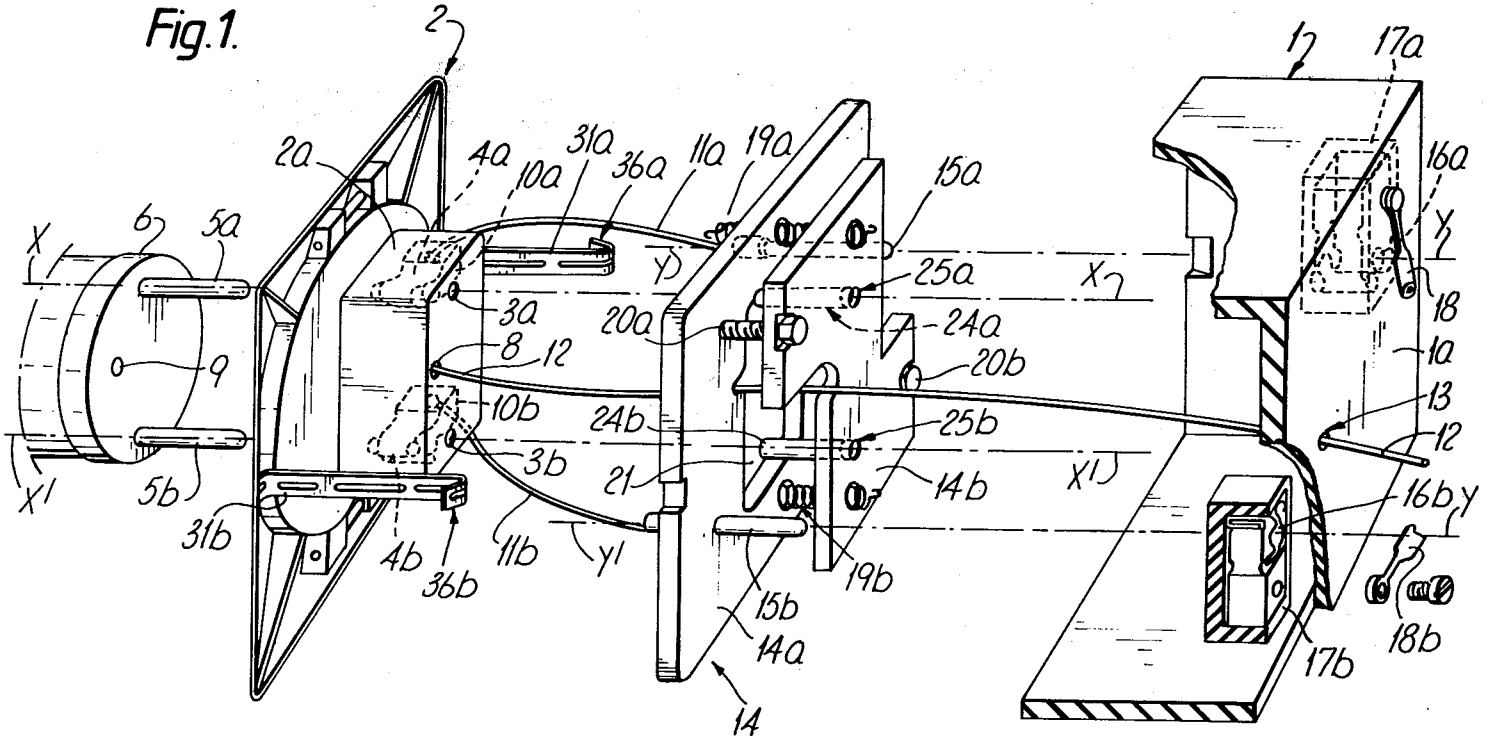
FIG. 1 is an exploded perspective view of a first form of embodiment of the anti-electrocution socket-outlet according to the present invention.
Figure 2:
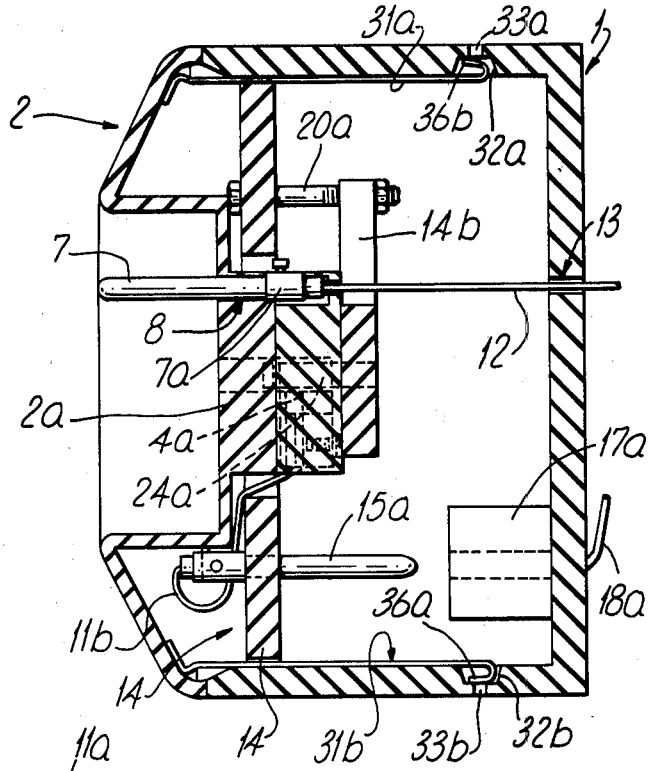
FIG. 2 is an axial sectional view of the socket-outlet before the introduction of a male plug.

As shown by FIGS. 1 to 3, the conductor 12 can be constituted directly by the terminal of the earth wire introduced into the socket-outlet through a hole 13 formed in the back of the casing.

The socket-outlet likewise comprises a connection panel 14 formed of an insulating material and mounted with a capacity for displacement parallel with the axes x—x and x'—x' of the conductive sockets 4*a* and 4*b*.

This axially mobile connection panel carries connection members 15*a*–15*b* oriented towards the rear and positioned offset in relation to the axes x—x and x'—x' of the conductive sockets 4*a*–4*b*.

These connection members can be constituted by pins oriented towards the rear and disposed parallel with the axis of the socket-outlet (FIGS. 1 to 3, 7, 8, 10 and 11), or by contact pieces disposed in a plane perpendicular to the said axis (FIGS. 4 and 5) in order not to increase the thickness of the socket-outlet.

Each of these connection members is connected, for example by means of a screw connection, to the end of one of the flexible conductors 11*a*–11*b*, the other end of which is connected to one of the sockets 4*a*–4*b*.

The connection panel can likewise carry a supplementary connection member 22 oriented towards the rear and preferably disposed offset in relation to the earth pin 7, the said pin and the said supplementary connection member (constituted by a pin disposed parallel to the axis of the socket-outlet or by a contact piece placed perpendicularly to the said axis) being connected by means of a flexible conductor 12'.

The connection panel can be constituted by a single insulating plate (FIGS. 4, 5 and 11) or can comprise two spaced walls 14*a*–14*b* disposed in parallel planes (FIGS. 1 to 3, 7, 8 and 10).

According to the form of embodiment as illustrated in FIGS. 1 to 3, the connection panel is constituted by two insulating plates assembled disengageably by stays 20*a*–20*b*. However the plates 14*a*–14*b* could also be moulded in one piece with the stays.

Figure 7:
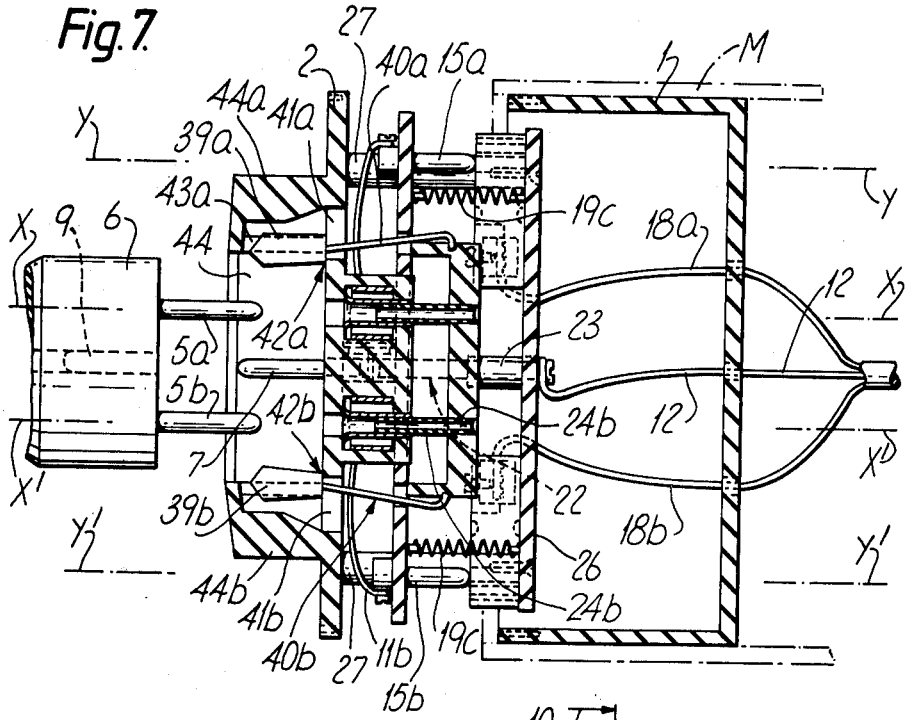
FIG. 7 is an axial sectional view of a third form of embodiment of the electric socket-outlet equipped with means for locking the mobile connection panel, the said socket-outlet being represented before its fixing in a casing which has previously been set into a wall, and before insertion of a male plug.
Figure 8:
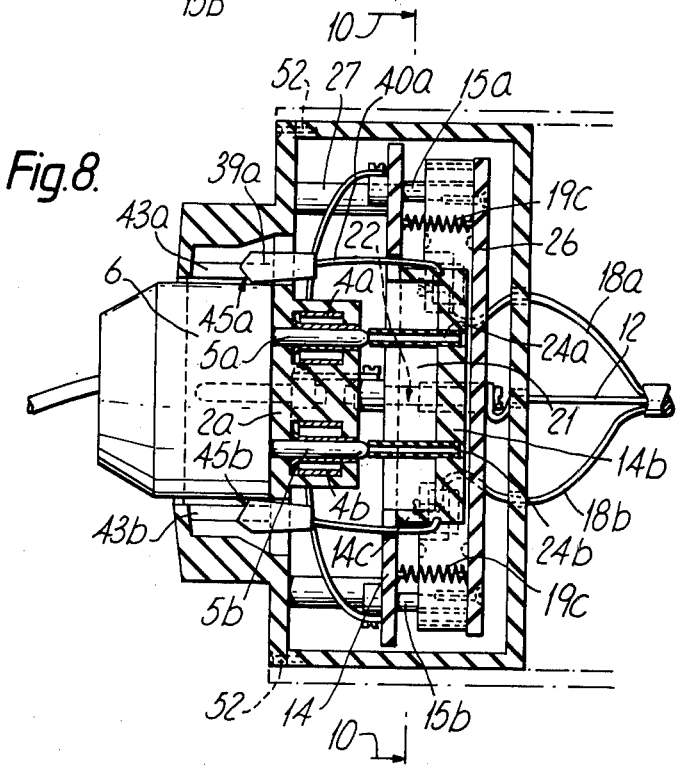
FIG. 8 is a view similar to FIG. 7, the socket-outlet being illustrated installed in the said casing and after insertion of a male plug.
Figure 9:
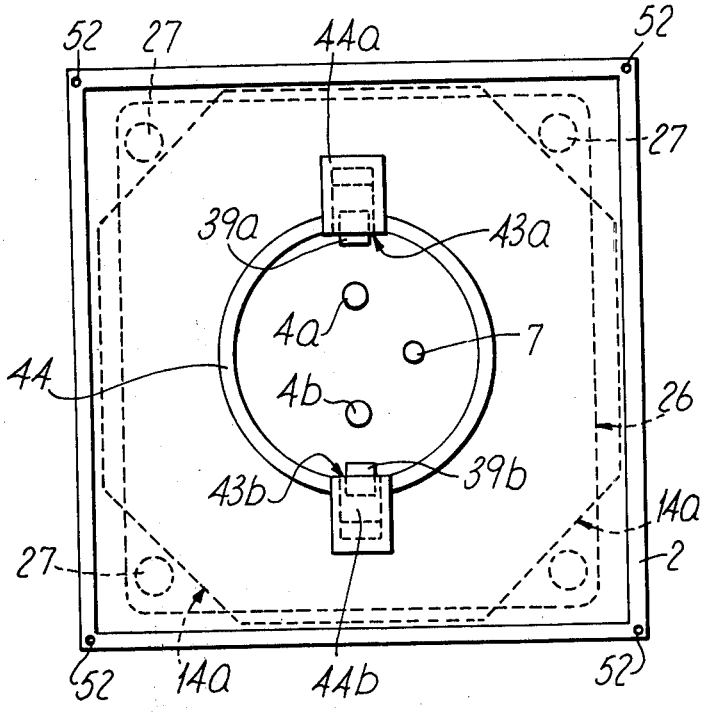
FIG. 9 is a front view of this socket-outlet.
Figure 10:
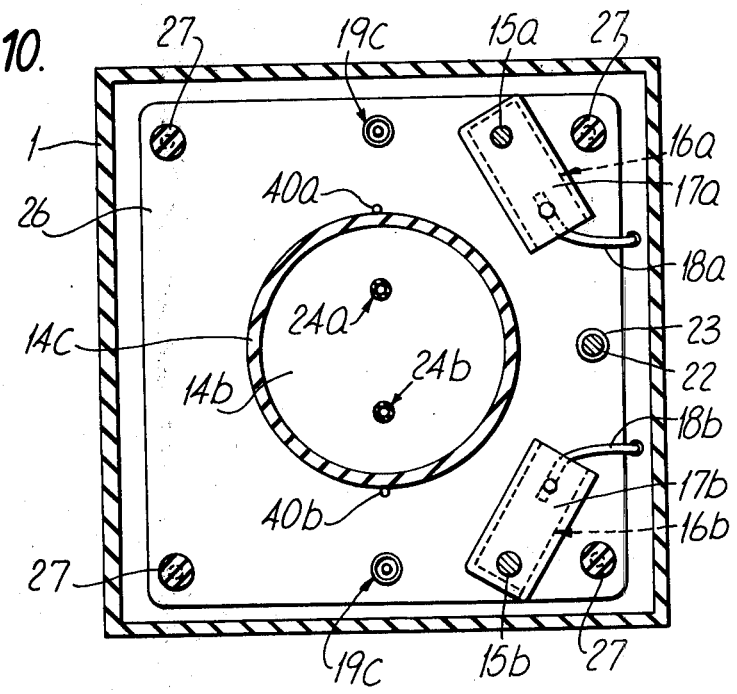
FIG. 10 is a sectional view along the line 10—10 in FIG. 8.

FIGS. 7, 8 and 10 represent a construction of this kind in which the front wall 14*a* is assembled to the rear wall 14*b* by a lateral wall 14*c* having for example a cylindrical form and moulded in one piece with these walls. The front wall 14*a* carries the pins 15*a*–15*b* and 22 and is provided with a central aperture 21 of circular or other form intended to permit the passage of the thicker part 2*a* when the connection panel occupies a position close to the front wall 2 of the socket-outlet (FIGS. 2 and 8).

According to the example of embodiment as represented in FIGS. 7, 8 and 10, the lateral wall 14*c* is fast on the one hand with the periphery of the rear wall 14*b* and on the other with the edge of the aperture 21 of the front wall 14*a*.

The connection panel 14 carries two drive barrels 24*a*–24*b* oriented forward and disposed on the axes x—x and x'—x' of the sockets 4*a*–4*b*. These drive barrels are constituted by small tubes or hollow cylinders open at their extremities, the bore of which is of a diameter smaller than the external standardized diameter of the usually cylindrical pins 5*a*–5*b* of the male plugs.

The pins of the male plugs and the drive barrels could of course have a section (triangular, quadrangular, oval, etc.) other than the circular section which is most commonly used at present in the designs of electrical connection devices, the important point being that the passage formed in the drive barrels should have a section smaller than that of the pins of the male plugs, to prevent these pins from sliding into the said passage.

The drive barrels 24*a*–24*b* are fixed by their rear ends into holes or apertures 25*a*–25*b* which the connection panel 14 comprises, and especially in holes which rear wall 14*b*, of this panel possesses when it comprises two parallel plates or walls.

The socket-outlet further comprises a contact-carrier plate constituted by an insulating plate disposed to the rear of the connection panel and rigidly fast with the front plate 2 of the said socket-outlet, from which it is spaced by a fixed distance permitting the rearward movement of the said connection panel.

Figure 6:
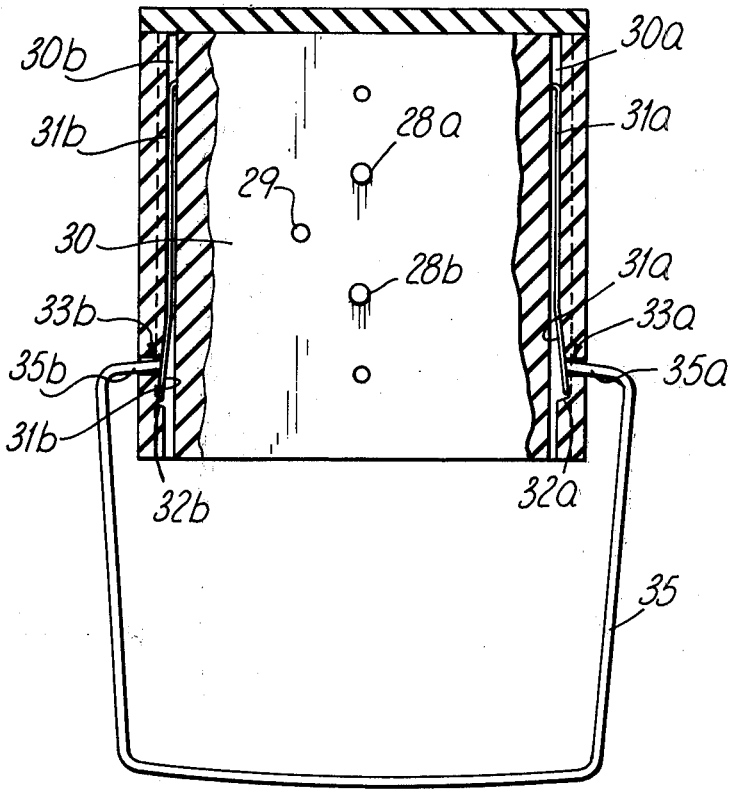
FIG. 6 is a cross-sectional view of the rear part of this socket-outlet equipped with a removable back plate.

According to the form of embodiment as illustrated in FIGS. 1 to 3, the contact-carrier plate is constituted by the back 1*a* of the casing 1 of the socket-outlet, while according to the embodiment as represented in FIGS. 4 and 6 the said contact-carrier plate forms the removable back wall 30 of the said casing.

FIGS. 7 to 10 illustrate another example of formation of the contact-carrier plate, where the said plate 26 is fixed by screwing upon the ends of small columns 27 fast with the front wall 2 and moulded integrally therewith.

On the front face of this plate there are fixedly installed, on the axes y—y and y′—y′ of the connection members 15*a*–15*b*, contacts 16*a*–16*b* which can advantageously be constituted by gripper sockets of known type, of form complementary to that of the said connection members and lodged in insulating blocks 17*a*–*17b* fast, for example by moulding, with the said front face of the said plate.

Figure 11:
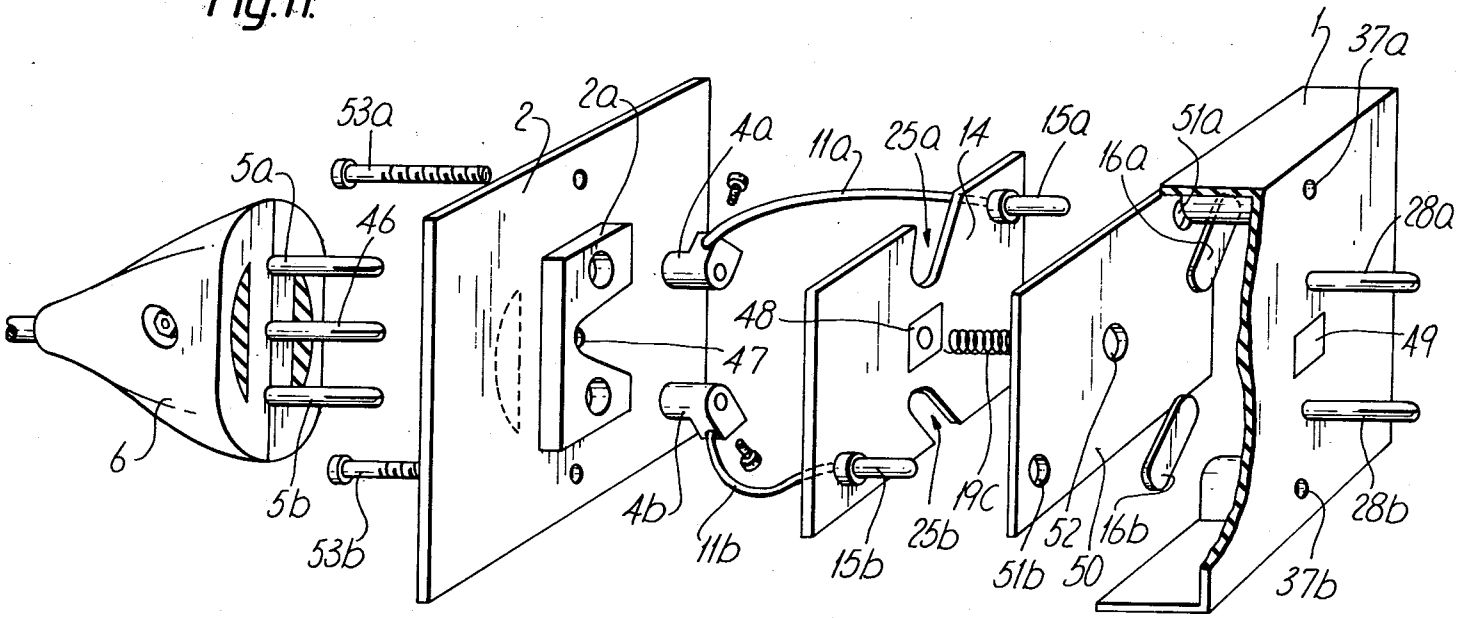
FIG. 11 is an exploded perspective view of a fourth form of embodiment of the socket-outlet according to the invention.

Each contact 16*a*–16*b* is intended to be connected, for example by means of a screw connection, with one of the feed wires 18*a*–18*b* of the pins (FIGS. 1 to 3, 7 and 8). Alternatively, and as illustrated in FIGS. 4, 6 and 11, the contacts 16*a*–16*b* can be connected to a pin 28*a*–28*b* issuing from the rear of the socket-outlet, so as to form a female-male connector which can be plugged into an ordinary socket-outlet in service, in order to avoid the dangers of electrocution by the latter without the need to replace it. In this case the screws 53*a*–53*b* serving for the fixing of the front wall 2 on the front face of the casing 1 are dimensioned to emerge from the orifices 37*a*–37*b* which the back of the said casing possesses, so that they can be screwed into threaded holes of the ordinary socket-outlet intended to receive the fixing screws of the cover of this outlet, so that a child cannot withdraw the safety socket-outlet from the ordinary socket-outlet.

The contact-carrier plate can likewise carry on its front face a supplementary contact 23 of form complementary to that of the connection member 22. This contact 23 can be arranged so that it can be connected to the end of the earth wire 12 (FIGS. 7, 8 and 10), or to a socket 29 accessible at the rear of the socket-outlet (FIGS. 4 and 6), permitting the introduction of the earth pin which the already installed ordinary current socket-outlet might comprise.

According to the example of embodiment as represented in FIGS. 7, 8 and 10, the contact 23 is formed by a small, forwardly oriented, conductor sleeve in which the pin constituting the connection member 22 can slide.

The connection members 15*a*–15*b*, such as pins or contact pieces, are dimensioned or disposed to be situated apart from the contacts 16*a*–16*b* when the mobile panel 14 occupies a position close to the front wall 2 of the socket-outlet, and to insert themselves into the said contacts when the said connection panel is displaced towards the rear, in such manner as to render the sockets 4*a*–4*b* live.

The earth pin 22 can remain permanently engaged in the sleeve 23, which thus plays a supplementary role as guide member in the movements of the connection panel. Means, advantageously elastic, ensure the return and retention of the connection panel 14 in the vicinity of the front wall 2 of the socket-outlet when the male plug is withdrawn from the latter.

According to the examples illustrated, these means are constituted either by helical tension springs 19*a*–19*b* (FIGS. 1 to 3) or 19 (FIG. 4) hooked by the opposite ends to the front wall 2 of the casing 1 and to the mobile connection panel 14 respectively, or by one or more compression springs 19*c* pressing with their opposite ends on the one hand against the said connection panel and on the other against the front face of the contact-carrier plate.

It will be understood that when a plug 6 is inserted into a socket-outlet of such arrangement, the pins 5*a*–5*b* of the said plug push back the drive barrels 24*a*–24*b*, the rearward displacement of which causes an identical movement of the connection panel 14 with which they are fast, in which movement the pins 15*a*–15*b* penetrate into the live gripper-sockets 16*a*–16*b*, which has the consequence of making the sockets 4*a*–14*b* of the socket-outlet likewise live (FIGS. 3 and 8).

If on the other hand a child should introduce conductive rods into the orifices of the socket-outlet, these would pass freely through the hollow drive barrels 24*a*–24*b* and the holes 25*a*–24*b* of the connection panel, without displacing the latter towards the rear. Under these conditions these rods, which at the end of their travel would abut against the insulating contact-carrier plate, would not be in contact with any live part of the socket-outlet and could not transmit any dangerous electric discharge to the child.

It is observed that in the situation of non-supply of the sockets 4*a*–4*b*, where the pins 15*a*–15*b* are spaced from the gripper-sockets 16*a*–16*b*, the free portions of the drive barrels are lodged in the said sockets (FIGS. 2 and 7). The separation of the connection members 15*a*–15*b* and the contacts 16*a*–16*b*, and consequently the interruption of the electric connection between the said members and the said contacts occur as soon as the distance between the male plug and the female socket-outlet reaches a few millimeters; this distance is so slight that a child cannot introduce its fingers between the said plug and the said socket-outlet.

According to the examples as represented in FIGS. 7 to 11, the front wall or cover 2 is fixed on the casing 1 by means of screws 36*a*–36*b* or 52, which appears to be the most rational solution in these forms of embodiment.

However the invention also relates to means permitting of fixing the removable wall of the socket-outlet on the casing thereof in such manner as to render this fixture inaccessible to children.

In this case the said removable wall can be constituted by the cover or front wall 2 of the said casing (FIGS. 1 to 3) or by the back plate 30 carrying the contacts 16*a*–16*b* (FIGS. 4 and 6).

The said removable wall carries two locking tongues 31*a*–31*b* having a capacity for elastic flexure. Complementarily two notches 32*a*–32*b* are formed internally in two opposite walls of the casing which further each comprise a hole 33*a*–33*b* opening into the said notches in which there engage the free extremities of the tongues 31*a*–31*b* when the removable wall of the said casing is in position. According to the example in FIGS. 4 and 6, the locking tongues 31*a*–31*b* are placed each at the bottom of a groove 30*a*–30*b* presented by two opposite edges of the plate 30 carrying the contacts 16*a*–16*b*.

This plate is fixed by transverse sliding to the rear of the casing which for this purpose comprises two opposite slots 34*a*–34*b* in which the internal walls 30*c*–30*d* defining the grooves 30*a*–30*b* are lodged. When the plate 30 is engaged and slid in the grooves 34*a*–34*b*, the elastic tongues 31*a*–31*b* are slightly flexed in the direction of the grooves 30*a*–30*b* in which they are installed, by reason of the pressure exerted by the casing wall portions disposed before the notches 32*a*–32*b*. At the end of the stroke the ends of the said flexible tongues drop into the said notches and effect the locking of the plate.

The withdrawal of the plate, in case of necessity, can be effected only by pushing back the extremities of the flexible tongues 31*a*–31*b*, through the holes 33*a*–33*b* in order to disengage them from the notches 32*a*–32*b*. For this purpose one may use a special key 35 equipped with two opposite noses 35*a*–*35b*, of which an extremely simplified version is represented in FIG. 6, the said key in this case being simply constituted by a metal wire bent into U-form the flexible side arms of which have their free ends turned inwards to constitute the said unlocking noses.

According to the example in FIGS. 1 to 3, the flexible locking tongues 31*a*–31*b* are fast, by one of their ends, with the cover 2, and extend to the rear. According to this arrangement the free ends of the tongues are turned outwards to constitute locking hooks 36*a*–36*b* intended to co-operate with the notches 32*a*–32*b*. These locking hooks can advantageously possess an outer surface which is conical or inclined in relation to the axis of the socket-outlet, so that when the ends of the flexible tongues are pushed back with the aid of the key 35, through the holes 33*a*–33*b*, the noses 35*a*–35*b* of the said key slide over this surface and tend to push the cover slightly forward, which facilitates its extraction from the casing of the socket-outlet.

According to the present invention the socket-outlet is also equipped with locking means prohibiting the rearward movement of the connection panel 14 other than by the introduction of a suitable male plug. As illustrated in FIGS. 7 to 10 these means comprise at least one bolt, preferably two bolts 39*a*–*39b*, each of which is carried by the forward end of a spring 40*a*–40*b* constituted by a rod or flexible blade the opposite end of which is fast with the connection panel. These springs emerge from the front face of the connection panel and are disposed for example diametrically oppositely on the rim of the central aperture 21 of the panel.

The bolts 39*a*–39*b* are mounted slidably in orifices 41*a*–41*b* which the front wall 2 possesses. These bolts comprise a nose 42*a*–42*b* each engaging with the edges of the orifices 41*a*–41*b*, when no plug is engaged in the socket-outlet. In this position they pass through lateral openings 43*a*–43*b* formed in a protective collar 44 fast with the front face of the front wall 2 and moulded in one piece with the latter. Each of these apertures opens into a small cowl 44*a*–44*b* likewise fast with the front face of the socket-outlet and moulded in one piece with the said wall.

Convergent ramps 45*a*–45*b* are formed on the internal face of the free end of each bolt 39*a*–39*b*, so as to favour the spacing of these on introduction of a male plug into the female socket-outlet.

When no male plug is engaged in the female socket-outlet, the mobile connection panel 14 occupies a position close to the front wall 2 of the said socket-outlet. In this position the bolts 39*a*–39*b* are partially lodged in the cowls 44*a*–44*b* and are in engagement, by their noses 42*a*–42*b*, with the rims of the orifices 41*a*–41*b*, as indicated above, while the pins 15*a*–15*b* are spaced from the contacts 16*a*–16*b*, so that the sockets 4*a*–4*b* of the socket-outlet are not live (FIG. 7).

If a child should introduce into the orifices of the socket-outlet conductive rods of diameter smaller then that of the passage formed through the hollow drive barrels 24*a*–24*b* and the holes 25*a*–25*b* of the connection panel, these rods would pass freely through the said drive barrels and the said holes, without displacing the panel to the rear. Under these circumstances these rods, which at the end of their travel would abut against the insulating contact-carrier plate 26, not being in contact with any live member of the socket-outlet, would be unable to transmit any dangerous electric discharge to the child.

If the diameter or the section of these rods is greater than the diameter or section of the passage through the hollow drive barrels 24*a*–24*b* and the holes 25*a*–25*b* of the connection panel, the latter again cannot be pushed back into the contact position, by reason of the locking action exerted by the bolts 39*a*–39*b*.

So that the sockets 4*a*–4*b* of the socket-outlet may be made live, it is essential to introduce a suitable plug into the said socket-outlet. At the beginning of this introduction the body of the plug separates the bolts 39*a*–39*b*, the noses 42*a*–42*b* of which escape from contact with the rims of the orifices 41*a*–41*b*. It is then possible to push the plug in completely, its pins 5*a*–5*b* pushing back the drive barrels 24*a*–24*b*. The pushing back of the said drive barrels causes an identical movement of the connection panel 14, at the end of which the pins 15*a*–15*b* penetrate into the live contacts 16*a*–16*b*, with the consequence of likewise making the sockets 4*a*–4*b* live (FIG. 8).

In the displacements of the connection panel the bolts 39*a*–39*b* slide freely in the holes 41*a*–41*b*. When the plug 6 is withdrawn from the socket-outlet, the springs 19*c* return the connection panel 14 forward, causing separation of the pins 15*a*–15*b* and the contacts 16*a*–16*b* and consequently disconnection of the sockets 4*a*–4*b*. The return of the connection panel likewise involves a forward movement of the bolts 39*a*–*39b* which, at the end of the forward stroke, come into engagement with the edges of the holes 41*a*–41*b*.

It will be understood that the socket-outlet as just described confers absolute security against the risk of electrocution, even if children should succeed in introducing slender conductive objects into the sockets of the said socket-outlet.

The embodiment as illustrated in FIG. 11 differs from those represented in the other Figures of the drawing, in that the rearward displacement of the connection panel 14 is effected by the thrust exerted by a supplementary earth pin 46, which the male plug 6 comprises.

Accordingly the front wall 2 of this socket-outlet comprises similarly a supplementary central hole 47 for the passage of the pin 46 which, when the plug is engaged in the socket-outlet, comes to press on the centre of the connection panel 14, which is equipped with a conductive metallic plate 48.

The spring 19*c* effecting the return of the connection panel to the vicinity of the front wall 2 and its retention there presses on the one hand against the plate 48 and on the other against a metallic element 49 fast with the back of the casing and connectable either to the earth wire or to a male pin intended to plug into the socket of an ordinary socket-outlet, if the anti-electrocution socket-outlet should be intended to be installed on such an ordinary socket-outlet comprising an earth socket.

In this embodiment the connection members 15*a*–*15b* are constituted by spring telescopic contact pieces, while the contacts 16*a*–16*b* against which the said contact pieces press when the connection panel is pushed to the rear are constituted by the conductive blades disposed between the back 1*a* of the casing and an insulating plate 50. The latter comprises holes 51*a*–51*b* situated opposite to the contact pieces 15*a*–15*b*, and the conductive blades 16*a*–16*b* possess a zone situated opposite to these holes. The plate 50 further comprises a central hole 52 for the passage of the spring 19*c*.

When the plug 6 is introduced into the female socket-outlet the pin 46 pushes back the mobile connection panel 14, compressing the spring 19*c*. The connection panel 14 moves back and the contact pieces 15*a*–15*b* penetrate into the holes 51*a*–51*b* and come into contact with the live blades 16*a*–16*b* situated at the bottoms of these holes. At the same time the pin 46 is earthed through the intermediary of the plate 48, the spring 19*c* and the element 49.

It is also observed that in the embodiment as illustrated the holes or apertures 25*a*–25*b* have the form of channels matching the form of the screw connectors of the sockets 4*a*–4*b* of the socket-outlet.

I claim:

1. An electric socket-outlet comprising:

(a) an insulating casing having at least front and back walls, (b) holes through said front wall for the reception of plug pins, (c) conductive sockets mounted on said front wall aligned with said holes and intended to receive the plug pins, (d) an insulating connection panel within said casing and displaceable parallel with the axes of the said holes, (e) resilient means ensuring the return of the said connection panel to the vicinity of the said front wall on withdrawal of the plug pins, (f) contacts mounted on said back wall and adapted for connection to an electric current source, (g) electrically conductive connection members mounted on said displaceable panel extending towards said back wall and aligned with said contacts and spaced from the said contacts when the connection panel is occupying a position close to the front wall, (h) means electrically connecting said conductive members with said conductive sockets, (i) apertures in the connecting panel arranged opposite to the conductive sockets, (j) means aligned with said conductive sockets for displacing said connection panel towards the back wall when the plug pins pass through said holes and are engaged in said conductive socket, so as to effect the junction of the said connection members and said contacts on said back wall, and (k) said connection members and said contacts being offset in relation to the axes of the said conductive sockets.

2. An electric socket-outlet according to claim 1, comprising a removable wall constituted by a front cover or a back plate, wherein the said removable wall carries two locking tongues capable of elastic flexure, the free extremities of which engage in two notches with which two opposite lateral walls of the casing are internally provided, which walls also comprise two apertures opening into the said notches and intended to permit the passage of the noses of an unlocking instrument.

3. An electric socket-outlet according to claim 1, intended to receive male plugs comprising a central earth pin, wherein the front wall of the said socket-outlet comprises a central orifice for the passage of the said central pin and the said mobile connection panel comprises, opposite to the said orifice, a metallic piece against which the forward end of a spring presses, the rear end of which spring is pressed against a metallic piece placed in the back wall and connected to earth, so that when the said male plug is introduced into the female socket-outlet the earth pin pushes the mobile connection panel to the rear, which has the effect of rendering the conductive sockets of the said socket-outlet live, and at the same time of earthing the central pin.

4. An electric socket-outlet according to claim 1, wherein the means by virtue of which it is possible ti displace the mobile connection panel are constituted by drive barrels fast with the said panel and oriented forward, these drive barrels being disposed in alignment with the conductive sockets and formed by small hollow tubes open at their extremities, the bores of which have a diameter smaller than the standardized diameter of the pins of the male plugs, the said drive barrels being installed in the holes of the connection panel, so that when a plug is engaged in the socket-outlet the pins of the said plug push back the said drive barrels the rearward displacement of which causes the rearward displacement of the mobile connection panel into the electric contact position.

5. An electric socket-outlet according to claim 4, wherein the drive barrels are at least partially lodged in the conductive sockets when the connection panel is occupying a non-conduction position close to the front wall of the casing of the said socket-outlet.

6. An electric socket-outlet according to claim 1, where the front wall possesses a supplementary orifice in which there is installed an earth pin emerging at the front end of the said front wall, wherein the said earth pin is connected to a supplementary connection member carried by the mobile connection panel and emerging from the rear face of the latter, while an earth contact is placed on the forward face of the back wall, opposite to the said supplementary connection member.

7. An electric socket-outlet according to claim 6, wherein the connection member connected to the earth pin is constituted by a pin lodged slidably in a conductive sleeve fast with the back wall or contact-carrier plate and adapted for connection to the end of the earth wire.

8. An electric socket-outlet according to claim 1, wherein locking means are provided prohibiting the rearward movement of the connection panel other than by the introduction of a matching plug into the said socket-outlet.

9. An electric socket-outlet according to claim 8, wherein the said locking means comprise at least one bolt and preferably two bolts each carried by a spring fast with the connection panel, these bolts emerging from the front wall of the socket-outlet and being mouted slidably in orifices formed in the said wall, the said bolts being in engagement with the edges of the said orifices when no male plug is engaged in the socket-outlet, while they are disposed so as to be automatically spaced and freed by the body of a male plug when the latter is pushed into the outlet.

10. An electric socket-outlet according to claim 7, comprising a protective collar fast with the front wall of the socket-outlet and surrounding holes in which the conductive sockets thereof are lodged, wherein the said protective collar possesses openings for the passage of bolts, these openings entering small cowls likewise fast with the said front wall and in which the said bolts are lodged when the socket-outlet is not in use.

* * * * *